United States Patent [19]

Aizawa

[11] Patent Number: 5,044,243

[45] Date of Patent: Sep. 3, 1991

[54] CUTTING APPARATUS

[75] Inventor: Tokushi Aizawa, Kanagawa, Japan

[73] Assignee: Cybernet Co., Ltd., Kanagawa, Japan

[21] Appl. No.: 445,545

[22] Filed: Dec. 4, 1989

[30] Foreign Application Priority Data

Aug. 10, 1989 [JP] Japan ..... 1-94004[U]

[51] Int. Cl.[5] ..... B26D 5/08

[52] U.S. Cl. ..... 83/558; 83/584; 83/607; 83/609; 83/694; 83/701

[58] Field of Search ..... 83/556, 558, 582, 584, 83/589, 609, 701, 607, 564, 694

[56] References Cited

U.S. PATENT DOCUMENTS

| | | | |
|---|---|---|---|
| 887,236 | 5/1908 | Dunbar | 83/609 |
| 950,099 | 2/1910 | Fischer | 83/609 X |
| 1,200,567 | 10/1916 | Yeakel | 83/584 |
| 1,864,830 | 6/1932 | Johnson | 83/584 |
| 2,477,295 | 7/1949 | Garwood | 83/584 |
| 3,242,786 | 3/1966 | Giordano | 83/582 |
| 3,476,043 | 11/1969 | Erdley | 83/607 X |
| 4,476,760 | 10/1984 | Block et al. | 83/582 |
| 4,491,046 | 1/1985 | Hosogaya | 83/589 |
| 4,791,843 | 12/1988 | Herrington et al. | 83/575 X |

*Primary Examiner*—Frank T. Yost
*Assistant Examiner*—Eugenia A. Jones
*Attorney, Agent, or Firm*—Fish & Richardson

[57] ABSTRACT

A cutting apparatus including a pair of blades respectively having linearly extending cutting edges so that the cutting edges are brought into sliding contact with each other to cut a member to be cut which is put between the cutting edges. The cutting apparatus is provided with press members for bringing the sliding contact surface of one of the cutting edges into press contact with the sliding contact surface of the other when the two blades are brought into sliding contact with each other, the press members being disposed along one of the blades. Thus, the sliding contact between the two blades is ensured independently of the rigidity of the blades. Accordingly, it becomes possible to reduce the thickness and increase the length of the blades.

1 Claim, 6 Drawing Sheets

CUTTING APPARATUS

BACKGROUND OF THE INVENTION

1. Field of the Invention

The present invention relates to a cutting apparatus.

2. Description of the Related Art

Cutting apparatuses of the type in which the cutting edges of a pair of linear blades are brought into sliding contact with each other to cut a sheet-like member, for example, paper, film, etc., put between the cutting edges have already been known. However, there have recently been increasing demands also for this type of cutting apparatus to decrease in weight and size and increase in the cutting speed.

More specifically, in cutting apparatuses used in plotters, printers, etc. to cut an exceedingly wide sheet-like member in the widthwise direction, a pair of stationary and moving blades which are in continuous form are employed and there is a tendency for the weight of the moving blade to increase more and more in proportion to the length. As the weight of the blade increases, however, it becomes difficult to control the high-speed movement of the blade and the cutting speed inevitably lowers.

If the thickness of the moving blade is reduced in order to reduce the weight, the rigidity lowers, so that, when the moving blade comes into sliding contact with the stationary blade, the cutting edge of the moving blade may bend and deflect from the cutting edge of the stationary blade due to the cut resistance, resulting in a gap being generated between the two blades, and thus causing a cutting failure.

SUMMARY OF THE INVENTION

In view of the above-described problems of the prior art, it is a primary object of the present invention to provide a cutting apparatus which is capable of ensuring the sliding contact between the two blades even if the blade rigidity is low, thereby reducing the blade weight, and thus achieving an increase in the speed of movement of the moving blade.

To this end, the present invention provides a cutting apparatus including a pair of blades respectively having linearly extending cutting edges so that the cutting edges are brought into sliding contact with each other to cut a member to be cut which is put between the cutting edges, wherein the improvement comprises press means for bringing the sliding contact surface of one of the cutting edges into press contact with the sliding contact surface of the other when the two blades are brought into sliding contact with each other, the press means being disposed along the blade.

In the cutting apparatus having the above-described arrangement, the sliding contact surfaces of the pair of blades are brought into press contact with each other by the press means and consequently the sliding contact between the two blades is ensured independently of the rigidity of the blades. Accordingly, it becomes possible to reduce the thickness and increase the length of the blades.

The above and other objects, features and advantages of the present invention will become more apparent from the following description of the preferred embodiments thereof, taken in conjunction with the accompanying drawings.

BRIEF DESCRIPTION OF THE DRAWINGS

FIGS. 1 to 9 show in combination a first embodiment of the present invention, in which:

FIG. 1 is a front view of a cutting apparatus;

FIG. 2 is an enlarged view showing the cutting apparatus with the middle portion thereof omitted;

FIGS. 3(*a*) and 3(*b*) are enlarged views each showing a combination of a pin and an elongated hole;

FIG. 4 is a sectional view showing a pin and an elongated hole associated therewith;

FIG. 5 is a perspective view showing a moving blade, stationary blade and press member;

FIGS. 6(*a*) and 6(*b*) are vertical sectional views showing the two blades; and FIGS. 7, 8 and 9 are sectional views respectively showing modifications of the press member or press means.

FIGS. 10 to 12 show in combination a second embodiment of the present invention, in which:

FIG. 10 is a perspective view of a paper cutter;

FIG. 11 is a vertical sectional view showing the blades and associated members of the paper cutter; and FIG. 12 shows a modification of the press member.

FIGS. 13 to 15 show in combination a third embodiment of the present invention, in which:

FIG. 13 is a schematic vertical sectional view of a paper cutter; and

FIGS. 14 and 15 are perspective views of the paper cutter.

FIGS. 17 to 21 show in combination a fifth embodiment of the present invention, in which:

FIG. 17 is a perspective view of a pair of scissors;

FIG. 18 is a perspective view showing the way in which a press member is attached to one blade of the scissors;

FIG. 19 is a vertical sectional view of the pair of blades of the scissors; and FIGS. 20(*a*), 20(*b*), 21(*a*) and 21(*b*) are vertical sectional views similar to FIG. 19, which respectively show modifications of the press member.

DESCRIPTION OF THE PREFERRED EMBODIMENTS

The present invention will be described below in more detail by way of embodiments and with reference to the accompanying drawings.

First Embodiment

Figure 1:
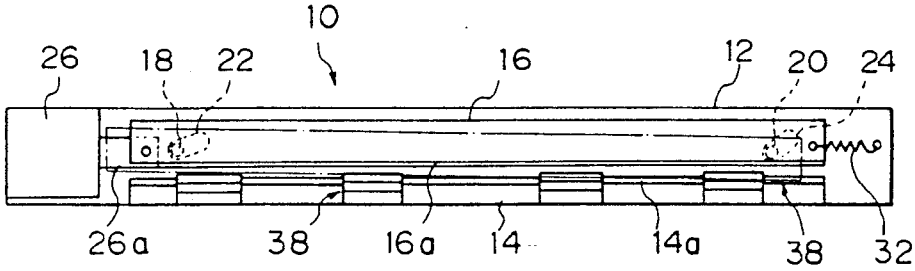

FIG. 1 is a front view of a cutting apparatus 10 according to a first embodiment of the present invention. In the figure, the reference numeral 12 denotes a support plate that extends horizontally. A pair of stationary blade 14 and moving blade 16 are attached to the support plate 12 along the lower and upper parts, respectively, of the support plate 12. Each of the blades 14 and 16 is formed in a continuous length from a thin steel plate, and cutting edges 14*a* and 16*a* are formed along the respective longitudinal edges of the blades 14 and 16 in opposing relation to each other, as is clearly shown in FIG. 2.

Figure 2:
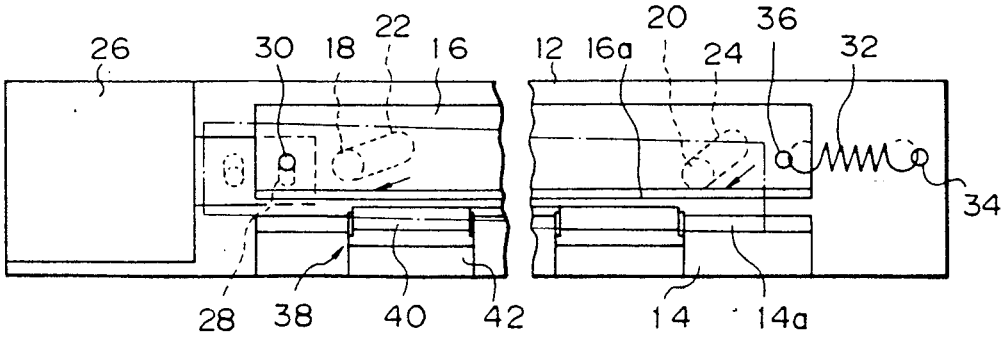
Figures 3A, 3B, 4:
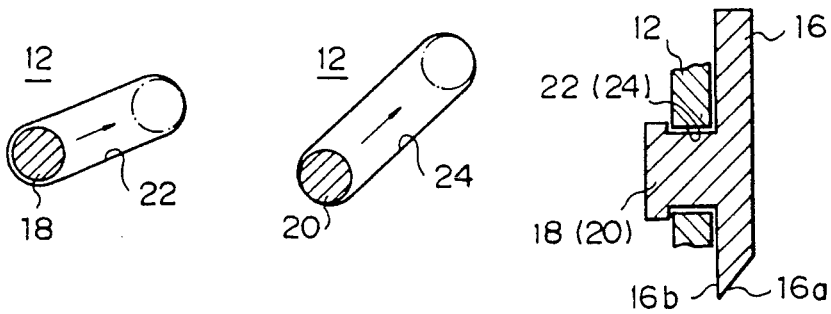

The moving blade 16 is attached to the support plate 12 in the manner described below. As shown in FIGS. 2 to 4, pins 18 and 20 are provided on one side of the moving blade 16 at two longitudinal end portions, respectively, the pins 18 and 20 being formed as integral parts of the blade 16. The pins 18 and 20 are loosely fitted in respective slant guide holes 22 and 24 which are formed in the support plate 12. Accordingly, when moved sideward, the moving blade 16 is caused to move vertically by the action of the guide holes 22 and 24. The drive of the moving blade 16 is effected by a solenoid-operated actuator 26 which is disposed at one end of the support plate 12. The actuating shaft 26*a* of the actuator 26 has an elongated connecting hole 28 formed in the distal end portion thereof, as shown in FIG. 2, and a connecting pin 30 that is integrally provided on one side of the moving blade 16 and at the end thereof which is closer to the actuator 26 is loosely fitted in the connecting hole 28. At the other end of the support plate 12 is disposed an extension spring 32 which is retained at one end by a retaining hole 34 in the support plate 12 and at the other end by a retaining hole 36 in the moving blade 16. Accordingly, the moving blade 16 is constantly biased rightward as viewed in FIG. 2, and when the actuator 26 is turned on, the moving blade 16 moves downward while being pulled leftward, as shown by the chain line in FIG. 2, whereas, when the actuator 26 is turned off, the moving blade 16 moves upward while being pulled rightward by the extension spring 32.

Figure 5:
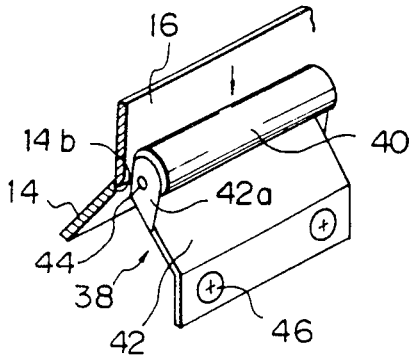
Figure 6A:
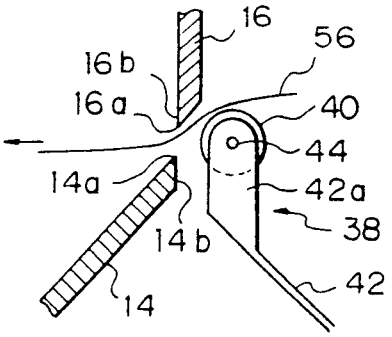
Figure 6B:
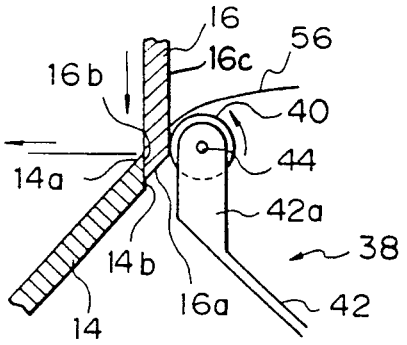

On the other hand, the stationary blade 14 is fixed to the support plate 12 at a predetermined angle so that the moving blade 16 comes into sliding contact with the stationary blade 14 at an angle, as shown in FIGS. 5 and 6. It should be noted that the stationary blade 14 is, although not clearly shown, rigidly secured to the support plate 12 over the entire length thereof so that it will not be deformed although the plate thickness thereof is relatively small.

In regard to the guide holes 22 and 24 in the support plate 12, more specifically, the right-hand (as viewed in FIG. 2) guide hole 24 slants more steeply than the left-hand guide hole 22 so that the moving blade 16 comes into sliding contact with the stationary blade 14 at a predetermined angle from the right-hand portion to the left-hand portion thereof.

A plurality of press members 38 are disposed at predetermined distances along the side of the support plate 12 which faces the sliding contact surface 14*b* of the cutting edge 14*a* of the stationary blade 14. Each press member 38 comprises a rotatable elongated press roller 40 and a resilient bracket plate 42. The shaft 44 of the roller 40 is supported by projections 42*a* provided at both ends, respectively, of the distal end portion of the bracket plate 42. The lower part of the bracket plate 42 is secured to the support plate 12 by means of screws 46. The gap between the roller 40 and the stationary blade 14 is set so as to be slightly smaller than the plate thickness of the moving blade 16 in a normal state so that, when the cutting edge 16*a* of the moving blade 16 is inserted into the gap, the bracket plate 42 is resiliently deflected a little backward.

Figure 7:
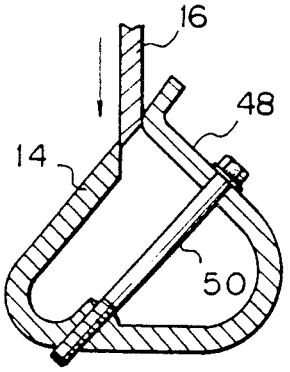
Figure 8:
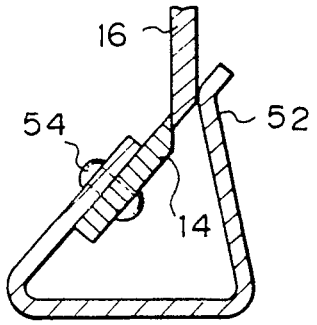
Figure 9:
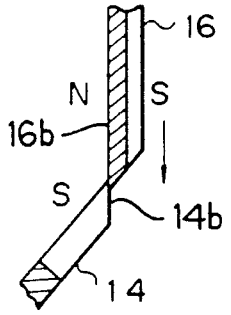

The press members 38, or press means, may be modified as shown in FIGS. 7, 8 and 9. The modification shown in FIG. 7 is arranged such that the stationary blade 14 and a press member 48 are formed integral with each other from the same member and the gap between the press member 48 and the stationary blade 14 can be adjusted by means of an adjusting screw 50. Since no roller is used, the frictional resistance to the moving blade may be greater than in the case of the first embodiment. However, this modification can be carried out at reduced cost because the structure is relatively simple. In the modification shown in FIG. 8, the stationary blade 14 and a press member 52 are formed from separate members, but these members are connected together in one unit by means of a rivet 54 with a view to setting the above-mentioned gap with high accuracy and facilitating mounting of these members to the support plate 12. In the modification shown in FIG. 9, the respective sliding contact surfaces 14*b*, 16*b* of the pair of cutting edges are brought into press contact with each other by means of magnetic force instead of the mechanical pressing force. More specifically, in this modification, the moving blade 16 is magnetized so that the front side (hatched side) of the moving blade 16 functions as the north pole and the other side thereof as the south pole, and the distal end portion of the stationary blade 14 which is brought into sliding contact with the moving blade 16 is magnetized so as to be the south pole. These magnetic polarities may, of course, be interchanged with each other.

In the above-described cutting apparatus 10, a sheet-like member 56 is delivered in the direction of the arrow through the area between the stationary blade 14 and the moving blade 16, as shown in FIG. 6(*a*). After the sheet-like member 56 has been delivered to a predetermined length, the solenoid-operated actuator 26 is turned on. In consequence, the moving blade 16 is pulled leftward as viewed in FIG. 2 by the actuating shaft 26*a* of the actuator 26. The cutting edge 16*a* of the moving blade 16 begins to come into sliding contact with the stationary blade 14 at a predetermined angle from the right-hand side thereof due to the difference in the gradient between the guide holes 22 and 24, and the sliding contact portion shifts successively to the left from it. When the moving blade 16 has come into sliding contact with the stationary blade 14 over the entire width thereof, cutting of the sheet-like member 56 is completed. During this cutting process, the above-mentioned cutting angle is maintained substantially at a constant level.

As shown in FIG. 6(*b*), at the same time as the cutting edge 16*a* of the moving blade 16 comes into sliding contact with the cutting edge 14*a* of the stationary blade 14, the press rollers 40 resiliently press the back surface 16*c* of the moving blade 16. Accordingly, even when the rigidity of the moving blade 16 is lower than in the case of the prior art because the blade 16 is thin, the moving blade 16 is prevented from deflecting rightward as viewed in FIG. 6(*b*), which would otherwise occur due to the cut resistance of the sheet-like member 56, thus enabling an effective cutting condition to be maintained. It should be noted that since the rollers 40 rotate when the moving blade 16 moves up and down, the resistance to the movement of the moving blade 16 has substantially no increase as compared with the prior art.

Second Embodiment

Figure 10:
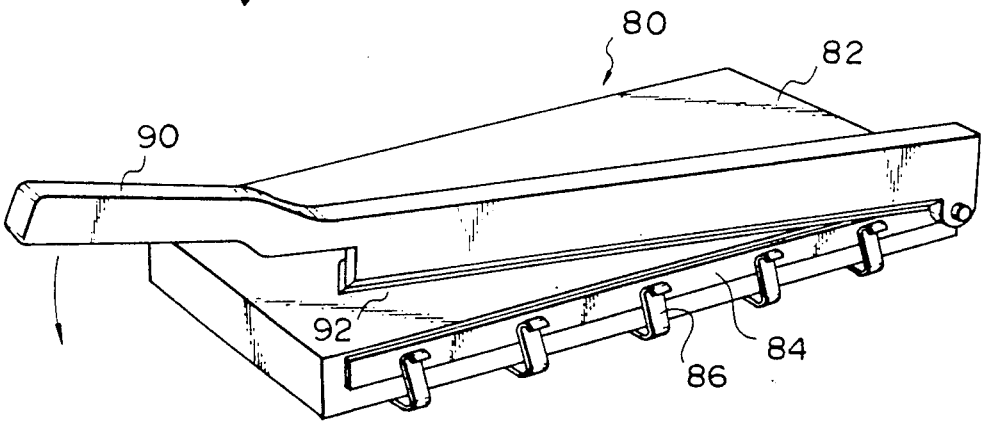
Figure 11:
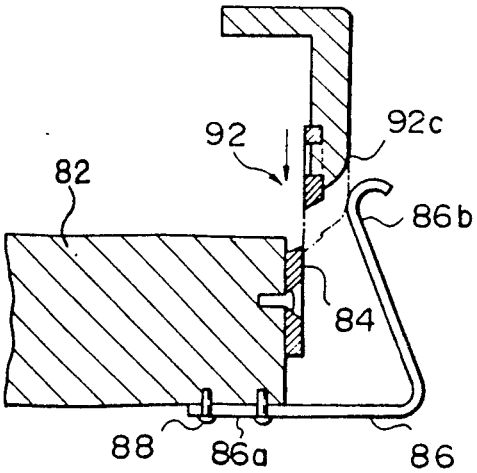
Figure 12:
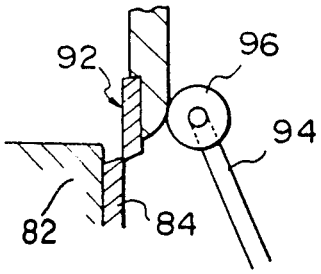

FIGS. 10 to 12 show in combination a second embodiment in which the present invention is applied to a paper cutter. The paper cutter 80 of this embodiment has press members 86 which are additionally attached to the base plate 82 of an ordinary paper cutter at respective positions near the stationary blade 84. More specifically, a plurality of press members 86 each formed from a substantially L-shaped member are disposed at predetermined distances along the longitudinal axis of the stationary blade 84. The lower end portion 86*a* of each press member 86 is secured to the lower side of the base plate 82 by means of screws 88, while the upper end portion 86*b* thereof is extended so as to face the sliding contact surface of the cutting edge of the stationary blade 84 across a predetermined gap.

When the handle 90 of the paper cutter 80 is pushed down to cut paper (not shown), the back surface 92*c* of the moving blade 92 is pressed by the upper end portions 86*b* of the press members 86, thus preventing the moving blade 92 from deflecting laterally outside from the stationary blade 84. Accordingly, excellent cutting can be effected without the need to specially apply inward force to the handle 90.

It should be noted that, if rollers are desired to be used for the press members, a roller 96 may be rotatably supported at the distal end of each press member 94 formed from wire, as shown in FIG. 12. With this arrangement, press members comprising rollers can be realized with relative ease and at relatively low cost.

Third Embodiment

Figure 13:
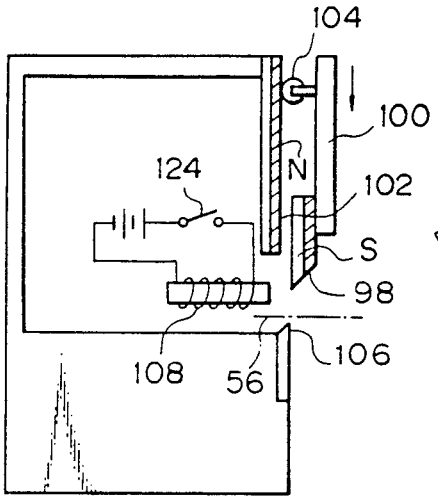
Figure 14:
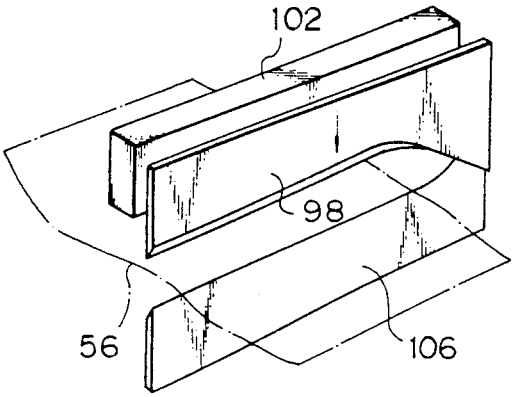
Figure 15:
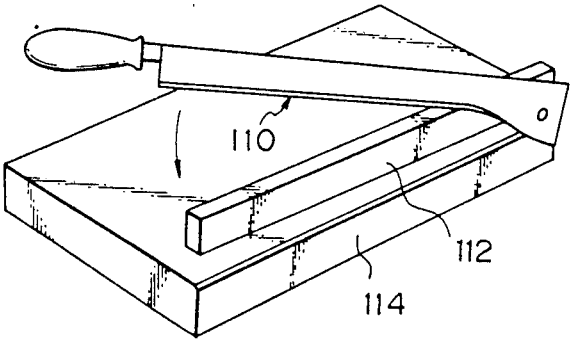

FIGS. 13 to 15 show in combination a third embodiment of the present invention, in which a moving blade is attracted toward a stationary blade by means of an electromagnet. Referring to FIG. 13, which is a schematic vertical sectional view of the paper cutter, a moving blade 98 which is formed into a permanent magnet is attached to an elevating support member 100 and a plate 102 made of permanent magnet is disposed along the vertical path of movement of the moving blade 98. The moving blade 98 and the elevating support member 100 are of extended length in the direction perpendicular to the plane of the drawing, and the extending end portion of the elevating support member 100 is connected to a driving means (not shown) so as to be driven to move up and down. The plate 102 and the moving blade 98 have their opposing surfaces made different from each other in magnetic polarity so that these opposing surfaces attract each other by magnetic force. For example, the opposing surfaces of the plate 102 and the moving blade 98 are defined as the north and south poles, respectively. The elevating support member 100 is provided with a roller 104 which rolls along the surface of the plate 102. The roller 104 maintains a predetermined gap between the moving blade 98 and the plate 102. If the arrangement is such that the amount by which the roller 104 projects from the moving blade 98 can be adjusted, it is possible to adjust the above-mentioned gap.

The foregoing paper cutter may also be arranged such that, instead of using the permanent magnet plate 102, a plate 102 that is not magnetized is used as a mere guide plate and an electromagnet 108 is newly disposed substantially horizontally at a position somewhat above the stationary blade 106, thereby attracting the moving blade 98 toward the stationary blade 106. In this case, if the coil 108 is energized to attract the moving blade 98 toward the stationary blade 106 only for the moment when the former comes into sliding contact with the latter, the power needed to drive the moving blade 98 can be minimized. The ON/OFF switching of the current circuit supplying current to the coil 108 may be effected by a switch 124 which opens and closes in association with the movement of the elevating support member 100.

FIG. 14 shows a modification which is the same as that shown in FIG. 13 except that it uses no elevating support member. The moving blade, the magnetic plate and the stationary blade are denoted by the same reference numerals as those in FIG. 13. FIG. 15 shows a hand operated paper cutter which uses the same principle as that in the arrangement shown in FIG. 13. In FIG. 15, the moving blade, the magnetic plate and the stationary blade are denoted by the reference numerals 110, 112 and 114, respectively.

It should be noted that, instead of using the magnetic plate, a solenoid coil may be buried in the stationary blade to magnetize the stationary blade itself at the time of cutting.

Fourth Embodiment

Figure 16:
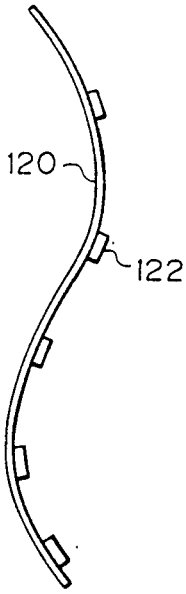
FIG. 16 is a plan view of a paper cutter according to a fourth embodiment of the present invention.

FIG. 16 is a schematic plan view of a cutting apparatus which enables a sheet-like member to be cut along any desired curve. In the figure, the reference numeral 120 denotes a moving blade in continuous thin plate form, which is driven to move up and down by a driving means (not shown) in the direction perpendicular to the plane of the drawing. The moving blade 120 is bent so as to coincide with a desired cutting curve, and a plurality of rollers 122 which serve as press members are disposed at one side of the moving blade 120 and along the longotudinal axis thereof so that, when the moving blade 120 comes into sliding contact with the stationary blade, the former is prevented from laterally deflecting from the latter by means of the rollers 122. It should be noted that illustration of the stationary blade is omitted in the figure.

This cutting apparatus realizes an epoch-making advantageous effect that a sheet-like member can be cut into a desired length along a desired curve including a circularly curved line, S-shaped line, etc. As press members, it is possible to adopt those which employ no rollers or those which utilize magnetic force produced from a permanent magnet and/or an electromagnet, in addition to the above-described press members comprising rollers.

Fifth Embodiment

Figure 17:
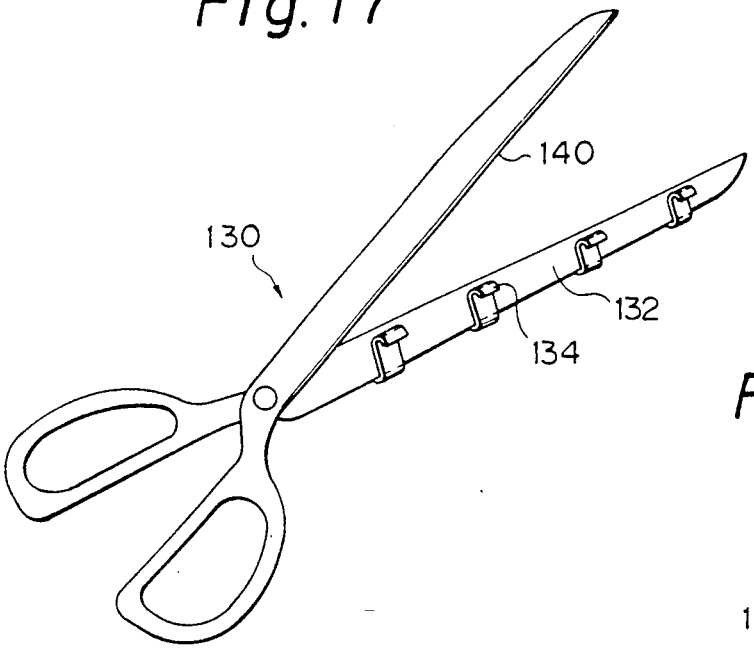
Figure 19:
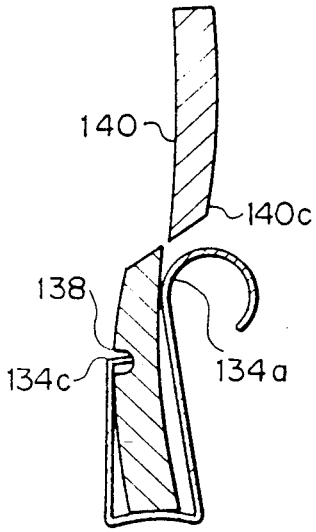
Figure 18:
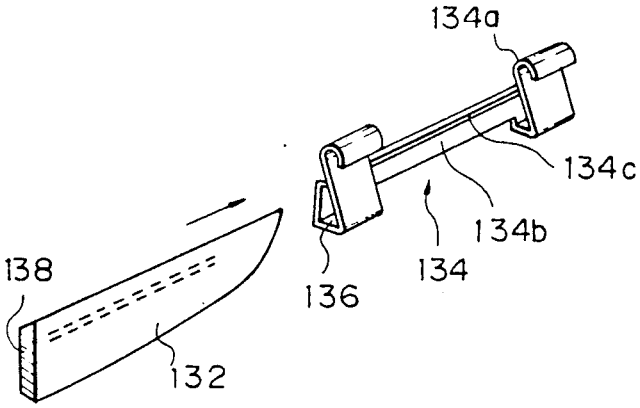

FIGS. 17 to 21 show in combination an embodiment in which the present invention is applied to a pair of scissors. These scissors 130 are different from ordinary scissors in that press members 134 are attached to one blade 132, as shown in FIG. 17. As specifically shown in FIG. 18, each press member 134 comprises two press portions 134*a* which are connected together through a connecting portion 134*b*. An L-shaped bent portion 134*c* which is bent inward is formed at the upper end of the connecting portion 134*b*, as shown in FIG. 19, and a groove 138 which is capable of receiving the bent portion 134*c* is formed in the outer surface of the blade 132. Accordingly, simply by inserting the blade 132 into a groove 136 defined between the press portions 134*a* and connecting portion 134*b* of the press member 134, the bent portion 134*c* and the groove 138 engage with each other and thus the press member 134 can be attached effectively and reliably. On the blade 132 are disposed two press members 134 and hence four press portions 134*a*. The press portions 134*a* are disposed so as to face the inner sliding contact surface 132*b* of the cutting edge 132*a* of the blade 132 so that, when the other blade 140 comes into sliding contact with the blade 132, the press portions 134*a* press the back surface 140*c* of the blade 140.

Figure 20A:
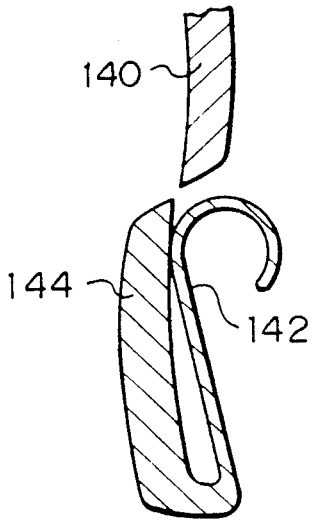
Figure 20B:
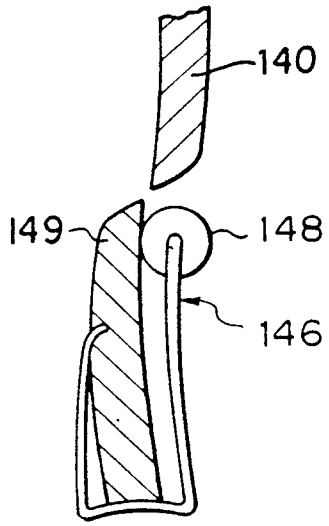

FIG. 20(*a*) shows a modification in which a press member 142 and a blade 144 are formed integral with each other, and FIG. 20(*b*) shows a modification in which a roller 148 is attached to the distal end of a press member 146 formed from wire attached to blade 149.

Figure 21A:
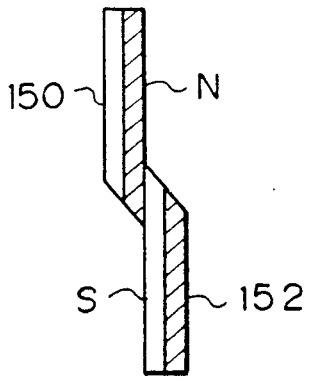
Figure 21B:
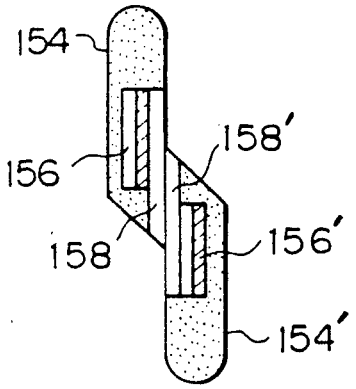

FIG. 21(*a*) shows a modification in which the inner sliding contact surfaces of a pair of blades 150 and 152 are magnetized so as to be different from each other in magnetic polarity, and FIG. 21(*b*) shows a modification in which a permanent magnets 156, 156' and/blades 158, 158' are buried in one unit in each of two support members 154, 154' made of a resin material. In these modifications, the pair of blades are attracted to each other by magnetic force and therefore prevented from moving away from each other when cutting an object to be cut.

Thus, according to the present invention, the sliding contact surfaces of a pair of blades of a cutting apparatus are brought into press contact with each other by press means. Accordingly, even if the rigidity of the blades is low, generation of a gap between the blades is prevented. It is therefore possible to reduce the thickness and weight of the blades, increase the length thereof and lower the production cost and, as a result of the reduction in the weight, it becomes possible to drive the moving blade at high speed.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A cutting apparatus including a pair of co-acting blades respectively having linearly extending cutting edges so that said cutting edges are brought into sliding contact with each other and create a sliding contact surface on each of said cutting edges, wherein said pair of blades comprise a first stationary blade and a second moving blade which are of continuous thin plate form, at least said second moving blade being formed from a magnetic material, and said second moving blade being adapted for movement in a first direction for sliding contact of the sliding contact surface of said second moving blade with the sliding contact surface of said first stationary blade, said cutting apparatus further comprising means arranged along at least a substantial segment of said first stationary blade for drawing the cutting edge of said second moving blade in a second direction, generally transverse to said first direction, toward the cutting edge of said stationary blade by means of magnetic force when said sliding contact surface of the cutting edge of said second moving blade comes into sliding contact with said sliding contact surface of the cutting edge of said first stationary blade, thereby drawing said sliding contact surface of the cutting edge of said second moving blade together with said sliding contact surface of the cutting edge of said first stationary blade.

* * * * *